US008978277B2

(12) United States Patent
Knight

(10) Patent No.: US 8,978,277 B2
(45) Date of Patent: Mar. 17, 2015

(54) DUAL THREAD HAMMERLESS WEDGE AND SPOOL

(71) Applicant: Raptor Mining Products Inc., Edmonton (CA)

(72) Inventor: Garrett D. Knight, Kincardine (CA)

(73) Assignee: Raptor Mining Products Inc., Edmonton, Alberta (CA)

( * ) Notice: Subject to any disclaimer, the term of this patent is extended or adjusted under 35 U.S.C. 154(b) by 0 days.

(21) Appl. No.: 13/986,659

(22) Filed: May 22, 2013

(65) Prior Publication Data

US 2013/0326919 A1 Dec. 12, 2013

Related U.S. Application Data

(60) Provisional application No. 61/689,440, filed on Jun. 6, 2012.

(51) Int. Cl.
*E02F 9/28* (2006.01)

(52) U.S. Cl.
CPC ..... *E02F 9/2833* (2013.01); *E02F 9/2825* (2013.01); *E02F 9/2891* (2013.01)
USPC ..... 37/456

(58) Field of Classification Search
USPC ..... 37/446, 452–458; 172/719, 772, 772.5; 403/374.1, 374.3, 374.4, 373
See application file for complete search history.

(56) References Cited

U.S. PATENT DOCUMENTS

| | | | | |
|---|---|---|---|---|
| 5,964,547 | A * | 10/1999 | Brinkley | 403/374.3 |
| 7,174,661 | B2 * | 2/2007 | Briscoe | 37/455 |
| 7,299,570 | B2 * | 11/2007 | Emrich et al. | 37/455 |
| 7,832,129 | B2 * | 11/2010 | Briscoe | 37/455 |
| 8,104,200 | B2 * | 1/2012 | Briscoe | 37/455 |
| 8,302,333 | B2 * | 11/2012 | Ruvang | 37/455 |
| 8,458,931 | B2 * | 6/2013 | Knight | 37/456 |
| 8,720,088 | B2 * | 5/2014 | Knight | 37/456 |
| 2004/0216336 | A1 * | 11/2004 | Briscoe | 37/455 |
| 2006/0010726 | A1 * | 1/2006 | Emrich et al. | 37/456 |
| 2011/0072693 | A1 * | 3/2011 | Knight | 37/456 |
| 2011/0252672 | A1 * | 10/2011 | Briscoe et al. | 37/456 |
| 2011/0258891 | A1 * | 10/2011 | Ruvang | 37/455 |
| 2013/0247429 | A1 * | 9/2013 | Campomanes | 37/456 |
| 2013/0269222 | A1 * | 10/2013 | Knight | 37/456 |

* cited by examiner

*Primary Examiner* — Matthew D Troutman

(57) ABSTRACT

An excavator tooth mounting member attachable to an abutment of an excavator shovel, for supporting an excavator tooth, wherein the abutment has an opening, and having a tooth mounting member with an opening, attachable to the abutment, a two part wedge secured within the openings which can be operated to expand or contract, and a rotary bolt in the wedge.

9 Claims, 3 Drawing Sheets

DUAL THREAD HAMMERLESS WEDGE AND SPOOL

FIELD OF THE INVENTION

This application is based on U.S. Provisional Application, 61/689,440, inventor, Garrett D. Knight, filed Jun. 6, 2012, Title: Dual Thread Hammerless Wedge and Spool, the priority of which is claimed. The invention relates to excavating equipment and in particular to such equipment incorporating a shovel or bucket, with replaceable teeth on the leading edge of the shovel.

BACKGROUND OF THE INVENTION

Heavy equipment used for earth moving and excavation must withstand abuse and abrasive working conditions. Such equipment incorporates a shovel or bucket and the bucket usually has a plurality of teeth on the leading edge of the bucket.

It is a common experience that such teeth become broken and must be replaced. In some cases the teeth are secured simply by a frictional fit, and may become loose and lost. In addition, the teeth are subjected to a very high rate of wear, and must be replaced at intervals even though they have not been broken or lost. A variety of different systems have been proposed for attaching such teeth to the bucket, which renders the teeth removable and replaceable. In one particularly useful system, abutments are secured permanently to the leading edge of the bucket. Tooth mounting members are releasably secured to the abutments, and the actual teeth are frictionally secured on the tooth mounting members. This system is useful in that it permits the teeth to be replaced, when lost or damaged, and in addition permits the tooth mounting members to be removed to facilitate changing the teeth and can be replaced as needed.

In addition, it is useful because it is possible to retrofit existing equipment such as shovels and excavators, by first of all securing the abutments to the existing shovel, and then using those abutments to secure tooth mounting members, and teeth on the tooth mounting members.

However, in such systems, some means must be provided for securing the tooth mounting member to the shovel abutment, in such a way that it is secure for use but is none the less rendered capable of being released and removed for replacement.

In the past, these systems have relied on some form of wedge device, and cooperating openings and surfaces in the tooth mounting member and the abutment. The wedge was simply hammered into place. Removing the wedge was tiresome and time consuming.

BRIEF SUMMARY OF THE INVENTION

For these reasons it is desirable to provide such an attachment system wherein there is an abutment on the shovel with an opening, a tooth mounting member also with an opening, attachable to the abutment to which an excavator tooth is attachable and in which the tooth mounting member is secured on the abutment by means of a two part wedge secured within the two openings, and which can be expanded, or contracted by operation of a threaded bolt or spool between the two parts.

It is a further objective of the invention to provide such an attachment system wherein the opening in the abutment on the shovel is perpendicular to the blade of the shovel, extending in essentially a vertical manner, and wherein the tooth mounting member has openings arranged along an axis complimentary to the axis of the opening in the abutment.

It is a further and related objective of the invention to provide such an attachment system wherein the threaded wedge has a front wedge portion and a rear wedge portion, separate from one another, and wherein the threaded bolt or spool is positioned between them, forcing them apart.

It is a further and related objective of the invention to provide such an attachment system wherein the front wedge portion is formed with a plurality of first threads of relatively fine pitch and wherein the rear wedge portion is formed with a plurality of rear wedge threads which are of relatively coarse pitch.

It is a further and related objective of the invention to provide such an attachment system and wherein the bolt has both fine threads, complimentary to the fine threads on the front wedge portion and wherein the bolt has coarse threads complimentary to the coarse threads on the rear wedge portion.

It is a further and related objective of the invention to provide such an attachment system wherein the front wedge portion is formed with an axial semi-cylindrical front groove, and the fine threads being formed in such groove, and wherein the rear wedge portion is formed with an axial rear groove, and wherein such coarse threads are formed in said axial rear groove.

It is a further and related objective of the invention to provide such an attachment system wherein the rear wedge portion has upper and lower wedging members defining wedging surfaces, engageable with said abutment on said shovel.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
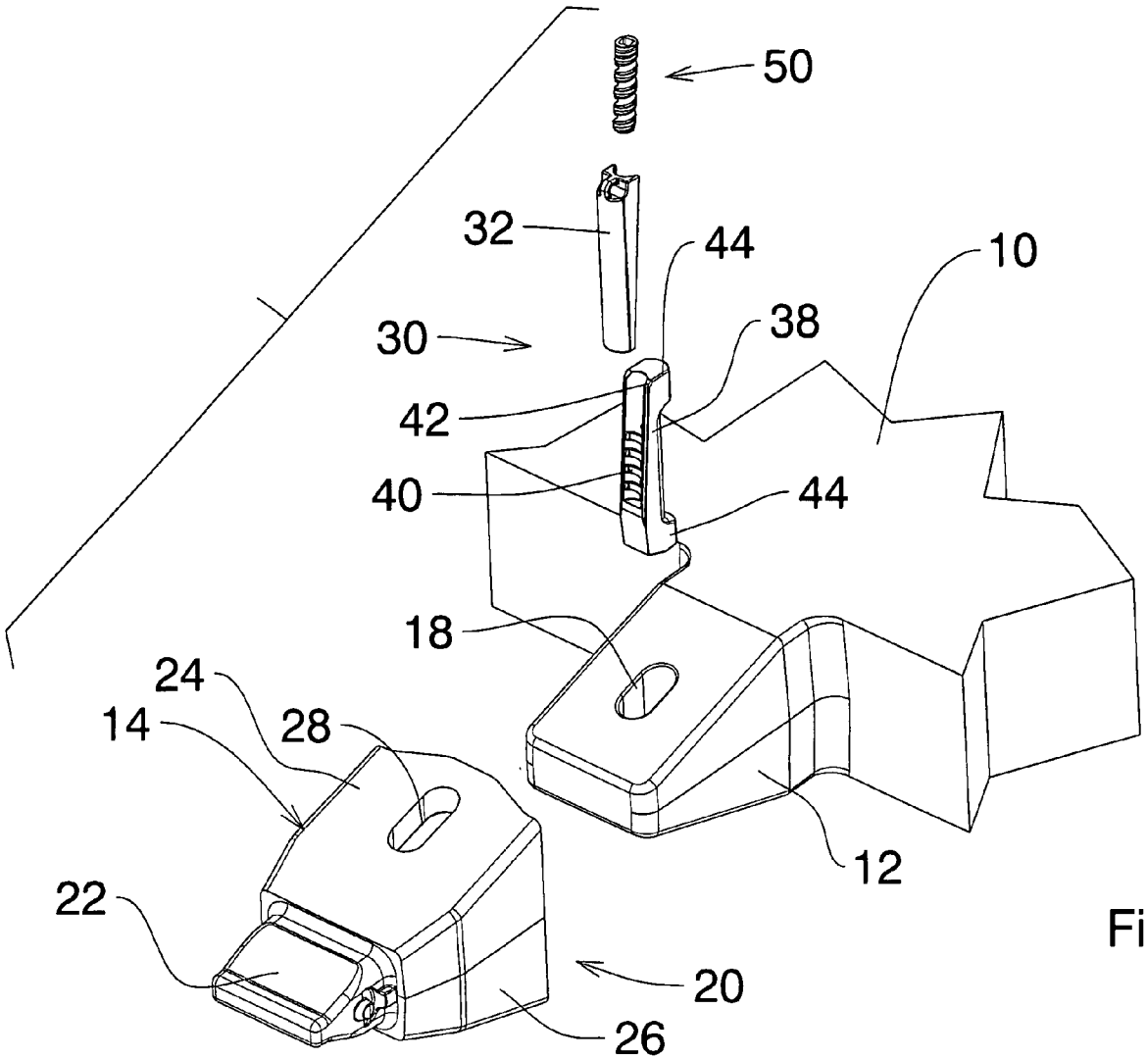
FIG. 1 is a perspective illustration exploded, showing a portion of the shovel and the tooth support mounting member.
Figure 2:
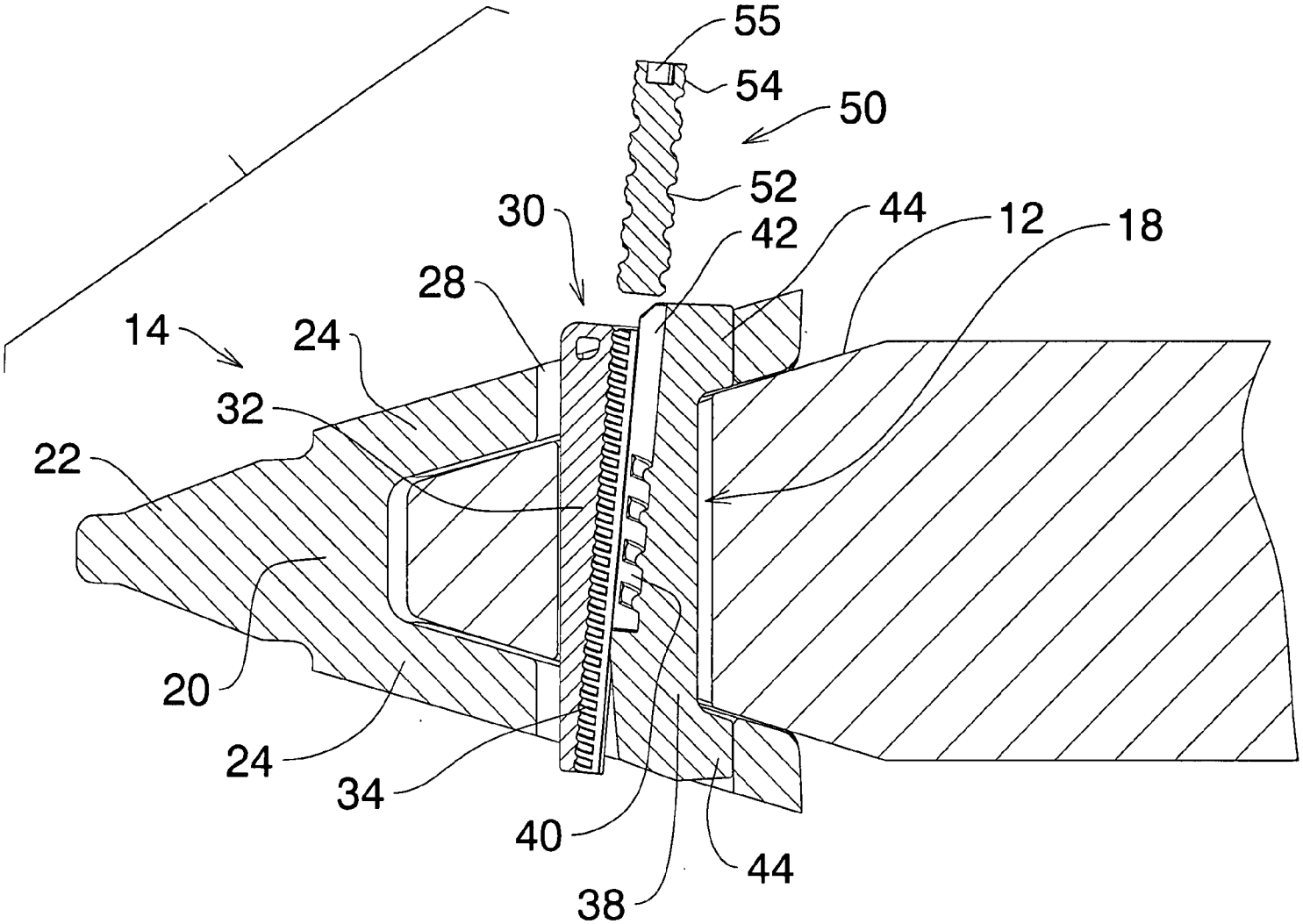
FIG. 2 is a section on along line 2-2 of FIG. 1.

Referring first of all to FIG. 1, a portion only of a typical excavator bucket is indicated as (10). It will be appreciated that excavator buckets or shovels of many different sizes and shapes may be fitted with the invention.

The excavator bucket is typically fitted with a series of abutments (12) along the lower part or blade of the bucket or shovel. The lower part (blade) of the bucket is usually on a horizontal transverse plane, as shown.

An excavator tooth mounting member (14) is supported on each abutment (12).

The excavator tooth itself is not shown but would be typically attached on the leading end of the mounting member (14). In most cases, such teeth are formed with recesses which fit on the leading end of the mounting member and simply make a friction fit.

The abutment (12) is formed with a through opening (18) for reasons to be described along an axis transverse to the blade. The mounting member itself comprises a steel body (20), which is formed with a leading end tip (22) for receiving a tooth (not shown).

The mounting body (20) is formed a recess opening of rectangular cross-section with walls, namely upper and lower clamp walls (24) & side walls (26), which are shaped to fit over the abutment (12) on the bucket.

The upper and lower walls(24) of the mounting member are formed with through openings (28). The through openings (28) extend from top to bottom through walls (24) along an axis complimentary to openings (18) and register with the through opening (18) in the abutment (12). In order to secure the mounting member firmly on the abutment, a wedge indicated generally as (30) is positioned through the openings (28) and (18). The purpose of the wedge is to force the walls (24) firmly back onto the abutment (12).

The wedge (30) consists of a front wedge bar portion (32), formed with first threads (34) which are relatively fine pitch threads. The bar (32) is formed with a generally semi-cylindrical recess (36), carrying the threads. The bar (32) tapers from a smaller lower end to a wider upper end.

Figure 3:
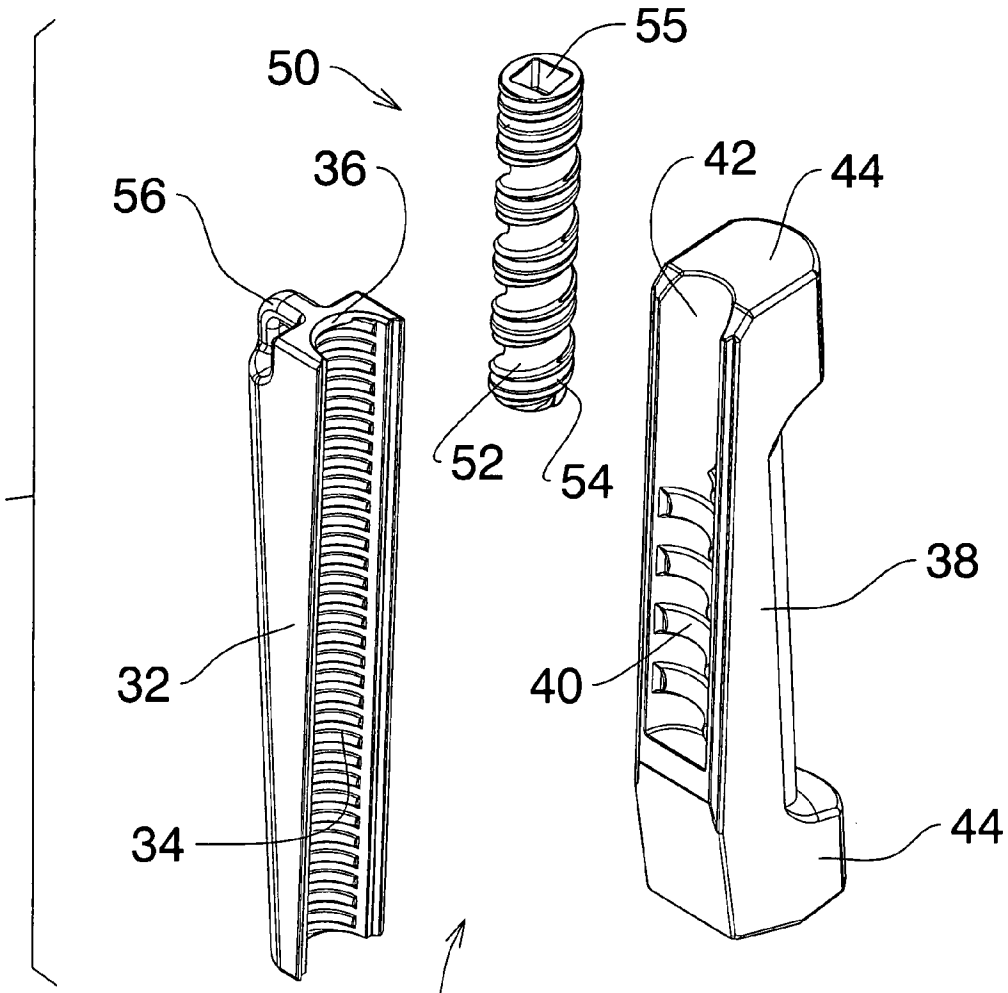
FIG. 3 is an enlarged view of the hammerless wedge and spool of the invention, exploded.

A rear wedge bar portion (38), is formed with coarse threads (40) of a relatively coarse pitch, in a generally semi-cylindrical recess (42). Rear wedge portion (38) is tapered, being wider at the lower end and narrow at the upper end (FIG. 3).

Rear portion (38) has lower and upper clamps (44) extending rearwardly.

The front wedge portion (32) and rear wedge portion (38) further cooperate with a dual pitch screw bolt or spool (50). The bolt (50) is formed with two separate sets of threads namely a coarse pitch thread (52) and a fine pitch thread (54) and a drive recess (55).

In operation, the mounting member is placed on the abutment, with the walls (24) (26) fitting over the surfaces of the abutment. The rear wedge portion (38) is then inserted through the openings (28) and (18). The front wedge portion (32) is then inserted and the bolt (50) is engaged with the coarse threads (40), and with the fine threads.

Clamps (44) engage the edges of upper and lower walls (24). The bolt (50) is then rotated and will drive down between the front wedge portion (32) and the rear wedge portion (38). As it does so, it will drive the front wedge portion (32) down into the openings (28) and (18), and force the two wedge portions apart.

The rear wedge portion (38) is secured by inter-engagement between said upper and lower clamps(44) and the mounting member caused by the front wedge portion moving relative to the rear wedge portion. This will thus produce a powerful force urging the walls (24) (26) of the mounting member back on to the abutment (12).

An eye (56) (FIG. 3) is formed at the top end of the front portion (32) to assist in removal of the wedge for removal of the tooth mounting members.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. An excavator tooth mounting system attachable to an abutment of an excavator shovel, for supporting an excavator tooth, wherein the abutment has an abutment opening, and comprising, a tooth mounting member with mounting openings, attachable to the abutment;

a two part wedge secured within the mounting openings and the abutment opening and able to expand or contract; the wedge having a front wedge portion further comprising a front wedge thread of a predetermined first pitch and a rear wedge portion comprising at least one rear wedge thread a second predetermined pitch, wherein said first pitch is finer than said second pitch the front and rear wedge portions being separable from one another, and a rotary bolt member positioned between said two part wedge portions, to separate said wedge portions and, expand said wedge.

2. The excavator tooth mounting system as claimed in claim 1 wherein the shovel defines a blade and wherein the openings in the abutments on the shovel are perpendicular to the blade of the shovel, extending in essentially a vertical manner, and wherein the tooth mounting member has mounting openings arranged along an axis complimentary to the axis of the openings in the abutments.

3. The excavator tooth mounting system as claimed in claim 1, wherein the bolt has first pitch bolt threads, complimentary to the first pitch threads on the front wedge portion and wherein the bolt has second pitch bolt threads complimentary to the second pitch threads on the rear wedge portion.

4. The excavator tooth mounting system as claimed in claim 3 wherein the front wedge portion is formed with a front axial semi-cylindrical groove, and the first pitch threads being formed in said front groove, and wherein the rear wedge portion is formed with a rear axial groove, and wherein the second pitch threads are formed in said rear axial groove.

5. The excavator tooth mounting member as claimed in claim 4 wherein the rear wedge portion has upper and lower arm members defining surfaces engageable with said mounting member.

6. The excavator tooth mounting system as claimed in claim 5 including an eye on said front wedge portion to facilitate removal of said wedge.

7. The excavator tooth mounting system as claimed in claim 4 wherein said front wedge portion tapers from top to bottom.

8. The excavator tooth mounting system as claimed in claim 5 wherein said mounting member defines a recess with an opening of rectangular cross-section, having top and bottom walls, and side walls and wherein said mounting openings are formed through said top and bottom walls.

9. The excavator tooth mounting system as claimed in claim 5 wherein said rear wedge portion is secured by inter-engagement between said upper and lower arm members and said mounting member and said front wedge portion is moveable relative to said rear wedge portion.

* * * * *